US005322218A

United States Patent [19]

Melbourne

[11] Patent Number: 5,322,218

[45] Date of Patent: Jun. 21, 1994

[54] METHOD AND APPARATUS FOR MAKING SNOW

[76] Inventor: John S. Melbourne, 10 Dellas Avenue Templestowe, Melbourne Victoria 3106, Australia

[21] Appl. No.: 847,028

[22] PCT Filed: Aug. 22, 1991

[86] PCT No.: PCT/AU91/00377

§ 371 Date: Apr. 27, 1992

§ 102(e) Date: Apr. 27, 1992

[87] PCT Pub. No.: WO92/06340

PCT Pub. Date: Apr. 16, 1992

[30] Foreign Application Priority Data

Oct. 5, 1990 [AU] Australia ..... PK 2657
Apr. 29, 1991 [AU] Australia ..... 76011/91

[51] Int. Cl.[5] ..... F25C 3/04

[52] U.S. Cl. ..... 239/2.2; 239/14.2

[58] Field of Search ..... 239/2.2, 14.2

[56] References Cited

U.S. PATENT DOCUMENTS

| | | | |
|---|---|---|---|
| 2,968,164 | 1/1961 | Hanson | 239/14.2 |
| 3,964,682 | 6/1976 | Tropeano et al. | 239/14.2 |
| 3,979,061 | 9/1976 | Kircher | 239/14.2 |
| 4,004,732 | 1/1977 | Hanson | 239/14.2 |
| 4,101,073 | 7/1978 | Curran | 239/14.2 |
| 4,105,161 | 8/1978 | Kircher et al. | 239/14.2 |
| 4,488,407 | 12/1984 | Delano | 62/74 |
| 4,634,050 | 1/1987 | Shippee | 239/2.2 |

FOREIGN PATENT DOCUMENTS

| | | |
|---|---|---|
| 37279/89 | 3/1990 | Australia . |
| 61-275599 | 12/1986 | Japan . |
| 1317-249 | 6/1987 | U.S.S.R. . |

*Primary Examiner*—Karen B. Merritt
*Attorney, Agent, or Firm*—Merchant & Gould Smith, Edell, Welter & Schmidt

[57] ABSTRACT

A snow making apparatus comprising a housing defining a bore (14) which is open at least at one end and having first and second annular chambers (38, 32) which extend circumferentially of the bore. The first and second chambers (38, 32) are respectively connectable to a source of pressurized water and of pressurized air. A circumferential array of outlets (42) from the first chamber (38) is operable with pressurized water supplied by chamber (38) to direct water jets along and towards the axis of the bore. A circumferential array of passages (36) provides communication between the second chamber (32) and the bore (14), each passage (36) opening towards or beyond the one end of the bore (14). The passages (36) discharge pressurized air supplied to the second chamber (32) as a plurality of air jets directed towards or beyond the one end of the bore (14). to generate a flow of air which passes beyond the one end of the bore (14). In use, the water jets impinge on the air jets to thereby generate snow particles which are carried axially beyond the one end of the bore (14).

32 Claims, 5 Drawing Sheets

METHOD AND APPARATUS FOR MAKING SNOW

This invention relates to a method and apparatus for making snow.

In one known method for making snow, water is sprayed into a high-volume air stream which is at a relatively low pressure and is at or below 0° C., such that the water spray droplets crystallize and fall to the ground as snow. The air stream is generated by a typically power driven fan, with the air stream confined for a distance downstream from the fan by a cylindrical housing. The power drive for such a fan, in order to provide a sufficient power output, has the major disadvantage of being noisy. This is unpleasant for operators, while it also is a problem in that snow making frequently is required to be done at night near living quarters. Also, the mechanical action of a fan in generating the required high velocity air-stream causes a slight increase in temperature of the air, and this can be sufficient to preclude efficient snow making where the ambient air temperature is close to the acceptable upper limit. Examples of such method are disclosed by U.S. Pat. No. 2,968,164 to Hanson, U.S. Pat. No. 3,979,061 to Kircher and U.S. Pat. No. 4,105,161 to Kircher et al.

An alternative method for making snow is disclosed in U.S. Pat. No. 3,964,682 to Tropeano. In this, high pressure air and water are ejected from a co-axial snow-making nozzle, and the resultant mixture expanded and cooled to form a stream of snow particles. Further high pressure water jets spray higher velocity water droplets into the stream of snow particles, to enhance the overall volume of snow and the wetness of the snow, and to extend the range over which the snow is dispersed. This alternative method obviates problems attributed to use of a fan generated air stream, but adds substantially to the complexity and resultant cost.

A pneumatic device, referred to as either an air mover or air pump, is capable of providing a high velocity air stream, but is not known to have previously been proposed for use in snow making. Such device has a tubular body defining a through bore. Between the ends of the bore, the body or a fitting secured thereto, defines an annular chamber which extends substantially concentrically around the bore. Pressurized air supplied to the chamber discharges into the bore as high pressure jets, via a plurality of passages providing communication between the chamber and the bore. The passages open toward one end of the bore such that a discharged high-volume air stream issues from that end. The pressurized air jets generate a reduction in pressure in the bore upstream from the passages, such that air is able to be drawn along the bore to increase the volume of the air stream. The passages providing communication between the chamber and bore extend in radial planes through the axis of the bore, and are inclined toward the axis, so that the jets converge at an axial location downstream of the chamber.

The present inventor has developed a modified form of such pneumatic device which substantially enhances its range of application. Such modified form is the subject of his Australian patent specification 607079 (AU-B-37279/88). In the modified device, the passages providing communication between the annular chamber and the bore are inclined so as to extend inwardly, but at an angle inclined to the axis of the bore, such that the jets do not converge to an axial location. Rather, the jets converge to define a throat of lesser diameter than the bore, and thereafter diverge outwardly.

It has been found that such pneumatic device, most preferably of the modified form, is able to be adapted for use in snow making apparatus. The present invention is directed to snow-making based on this discovery.

Snow making apparatus according to the invention includes a housing means which defines a bore open at least at one of opposed ends thereof. The housing means also defines first and second chambers which extend around the axis of the bore, and first and second connecting means for connecting the first and second chamber respectively to a source of pressurized water and a source of pressurized air. The housing means further defines a circumferential array of outlet means from the first chamber which are operable such that, with pressurized water supplied to the first chamber, a respective radially thin jet of water is directed from each outlet means along and towards the axis of the bore. The housing means further defines a circumferential array of passages by which the second chamber is in communication with the bore, preferably upstream from the outlet means from the first chamber with respect to the one end of the bore. Each passage has an inlet end communicating with the second chamber and an outlet end opening into, and towards or beyond the one end of the bore. The outlet end of each passage preferably is nearer to the axis of the bore than its inlet end. The arrangement of the passages is such that pressurised air supplied to the second chamber via the second connecting means is discharged via the passages as a plurality of air jets which are directed towards or beyond the one end of the bore, and preferably converge towards the axis to generate a flow of air which passes beyond the one end of the bore. In use of the device, the jets of water impinge on the flow of air jets to thereby cause generation of snow particles which are carried axially beyond the one end of the bore.

The first and second chambers are hereinafter referred to respectively as the water chamber and the air chamber.

The passages by which the air chamber communicates with the bore are inclined radially inwardly towards, but preferably also transversely with respect to the axis of the bore, such that the respective inclinations of jets of air issuing into the bore from the air chamber together define a flow of air which, extending axially from the air chamber, at first converges as if along a frusto-conical surface and thereafter diverges as if along a similar frusto-conical path. The jets of air thus preferably converge downstream of the air chamber to define a throat of reducing cross-section, down to a minimum cross-section, and thereafter diverge outwardly. Also, the jets of air, because of their preferred inclination transversely with respect to the axis of the bore, tend to impart a spiral path. Due to this flow pattern the turbulance of snow particles generated by impinging the water jets on the resultant air flow is substantially reduced.

As the high pressure air exits from the air passages into the bore, the issuing air undergoes a substantial drop in temperature, due to rapid expansion of the air. Thus, the air exiting from the air passages is chilled, and can drop in temperature by as much as 10° C. for a pressure drop of 700 Kpa, although a greater temperature drop is possible. This chilling effect greatly assists the crystallization of water droplets mixed therewith, and thus enhances the snow making ability of the device.

The angle of inclination of the water jets with respect to the axis of the bore is preferably such that the issuing water jets intersect the flow of air at a location close to the outlet ends of the passages to fully utilize the drop in temperature of the air. In one form, the water jets issue axially and an annular, inclined baffle is provided to deflect the water jets to intersect the flow of air. The baffle also serves to flatten the flow of water to a flow approaching that of a radially thin annular ring, rather than a series of circular jets spaced around the circumference of the bore. Satisfactory dispersion is found to result from such an annular ring.

In a preferred form of the invention, the water chamber is defined by the housing means immediately downstream from the air chamber. Pressurized water is discharged from a plurality of outlets from the water chamber which form part of the outlet means. The outlets are in a circumferential array, and each may be arranged to correspond with a respective air passage. The outlet end of each air passage may be defined by an elongate nozzle which extends within the bore such that the air jets issue downstream of the water outlets, with the water outlet means adapted such that the water jets intersect the air jets immediately adjacent the ends of the elongate nozzles to fully utilize the drop in temperature.

The respective flow of air and water into the air and water chambers is preferably tangential with respect to the bore, to generate a respective annular flow in each chamber. In such case, the preferred inclination of the air passages transversely with respect to the axis of the bore most preferably is in a direction such that the air flow from the air chamber, into the air passages, is a continuation of the annular flow of air in the air chamber. That is, the direction of transverse inclination of the passages is such that, in flow along the passages, the air has a component of flow which is in the same circumferential direction as the flow of air in the air chamber.

The bore preferably is open at each of its opposed ends. With a bore of this form, the outlet ends of the passages preferably are upstream from the one end of the bore such that the air jets, over an initial part of their length, are within the bore. As a consequence, the air streams generate a reduction of pressure in the bore, upstream of the outlet ends of the air passages, which causes ambient air to be drawn into and along the bore from the other end of the bore, for discharge from the one end of the bore with the air flow produced by the air jets. In such arrangement, the ambient air is cooled by the chilled air of the air jets, and the overall volume of air with which the water jets impinge is substantially increased. This enables an increase in the volume of water able to be discharged by the water jets and hence, the volume of snow able to be made. Also, the cooling of ambient air enables the apparatus to be used despite a relatively light ambient air temperature, such as up to about +5° C.

With the outlets for the air passages nearer to the one end of the bore, the amount of ambient air able to be drawn through the bore is decreased. At the limiting position, in which the air passage outlet ends are closely adjacent the one end of the bore, substantially no ambient air is drawn in and, in such case, the bore need be open only at its one end. In such case, the other end can be closed by an end member or transverse baffle, while the end member or baffle may be fixed or removable. With the air passage outlet ends adjacent to the one end of the bore, the chilled air of the air jets thus is not mixed with possibly warmer ambient air, and snow making is possible with an ambient temperature as high as about +10° C.

Upstream of the air chamber, the housing means, where the bore is open at each end, preferably is defined by an inlet portion which increases in diameter away from the air chamber i.e. to the other end of the bore. Along its axial extent, the increase in diameter preferably is by the inlet portion being belled so as to smoothly flare outwardly. The inlet portion most preferably is flared with a radius of curvature in excess of the radius of the bore adjacent the air chamber; the radius of curvature preferably exceeding that radius of the bore by a factor of from 1.0 to 1.6.

It is preferred that the outlet ends of the air passages are upstream from the one end of the bore, such that the jets of air issuing from the air passages give rise to a reduction of pressure within a zone upstream those outlets. That is, it is preferred that the apparatus is such as to provide suction at an inlet end of the bore, to draw air along the bore for discharge as a high-volume air stream at the one or outlet end. The water spray issuing from the water passages is directed inwardly to intersect the high-volume air stream so that the water spray droplets crystallize form snow particles. The water spray is scattered and dispersed further by also intersecting with the streams of air issuing from the air passages. Of course, it will be understood that the apparatus preferably is operated in ambient temperature conditions below the freezing point of water, so that crystallization occurs. Preferably, the apparatus will be operated at night when the ambient temperature at a minimum.

Particularly where the apparatus functions to draw ambient air in through the other or inlet end of the bore, it is preferred that the air passages are inclined both towards the bore axis, and laterally with respect to that axis. The air jets issuing from the air passages thus converge to a throat at which they do not reach the axis, and thereafter diverge outwardly. The resultant flow of air thus is of a helical nature, with turbulence being minimised. However, as the outlet ends of the air passages are located nearer to the outlet end of the bore, the benefit is having the air passages inclined with respect to the bore axis diminishes and which such inclination still is preferred, it can be omitted if required.

The apparatus is found to operate efficiently as a snow making machine. The strong flow pattern generated by the air passing from the air chamber enables greater efficiency of operation than known apparatus. The apparatus of the invention is also quieter in operation than known apparatus utilizing a fan to provide the high volume air stream. Known fan operated systems operate at about 120 dB, whereas the apparatus of the invention operates at about 80 dB. Further, the apparatus has been found to operate extremely efficiently at ambient temperatures close to 0° C., such as between −3° C. and 3° C., but even at higher ambient temperatures of from about 5° C. to 10° C.

In the form of the invention in which the bore is open only at the one end, it of course is not possible for air to be drawn through the bore of the device. For that form, the bore may in fact be a through bore open at each end, but with an end member, transverse baffle or panel, or a ball or the like in the bore having a diameter greater than the diameter of the bore and thus closing the inlet end of the bore. The device may be used in this form when the ambient air temperature is high (greater than about 0° C.), in order to avoid the mixing of comparatively warm ambient air with the expanding high velocity air jets and the issuing water spray. Thus, the snow making capacity of the device will be determined by the intersecting and mixing of the chilled air and water spray, respectively from the air and water chamber. Utilizing such form of the device will permit snow making to operate at ambient air at higher ambient temperatures above 3° C., such as from 5° C. to 10° C., due to the substantial temperature drop of the high pressure air jets.

Embodiments of the apparatus of the present invention are illustrated in the attached drawings. The following description of the drawings is not to be considered as limiting the above general description.

Figure 1:
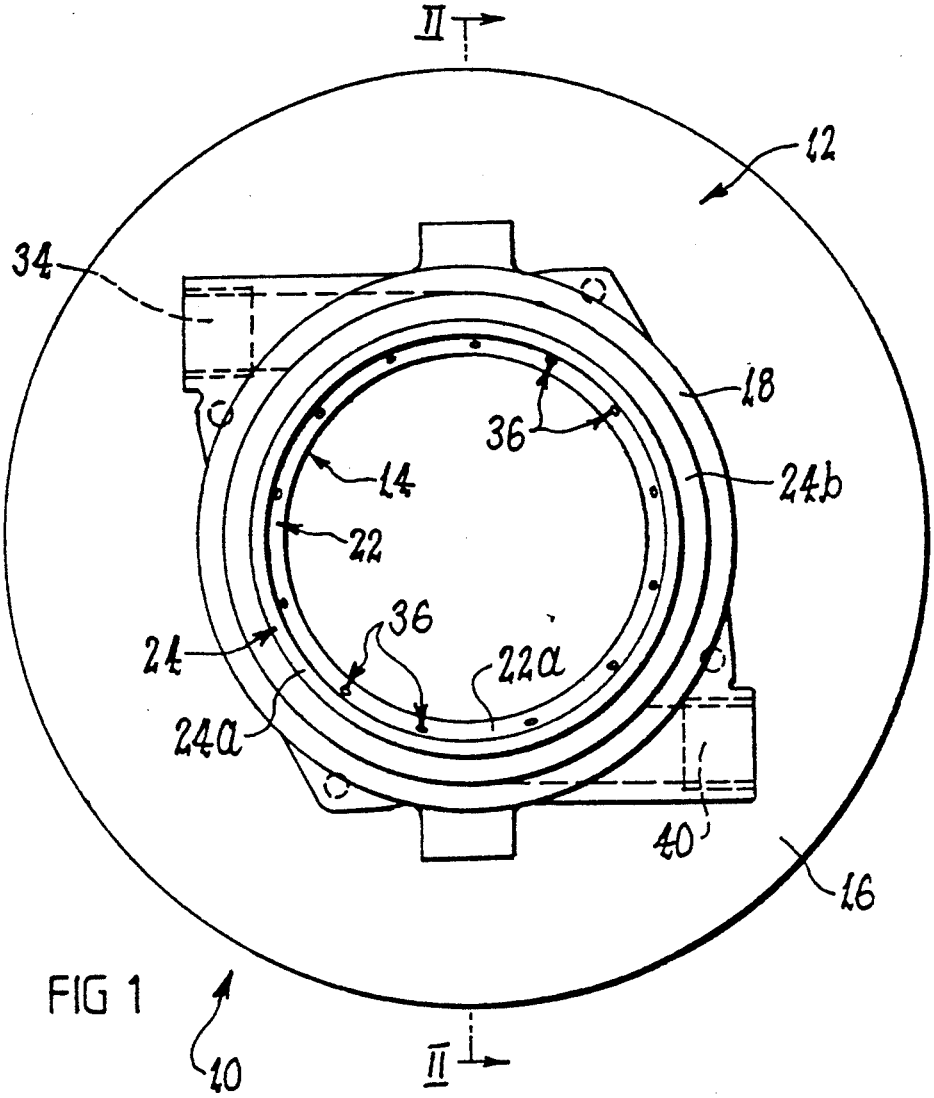
FIG. 1 is an end elevation of a device according to a first embodiment of the invention.
Figure 2A:
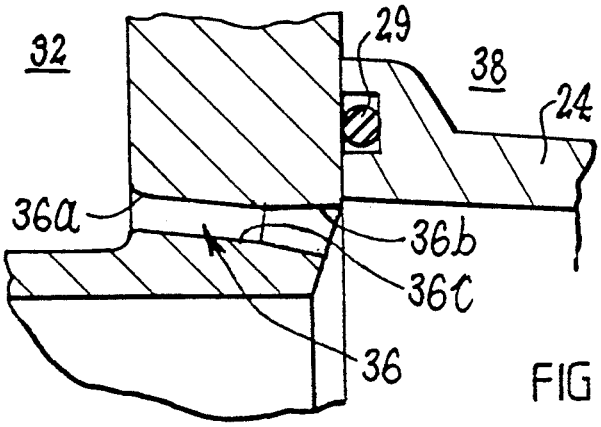
FIG. 2A is an enlarged view of the structure of FIGS. 1 and 2, but showing an alternative arrangement.
Figure 2:
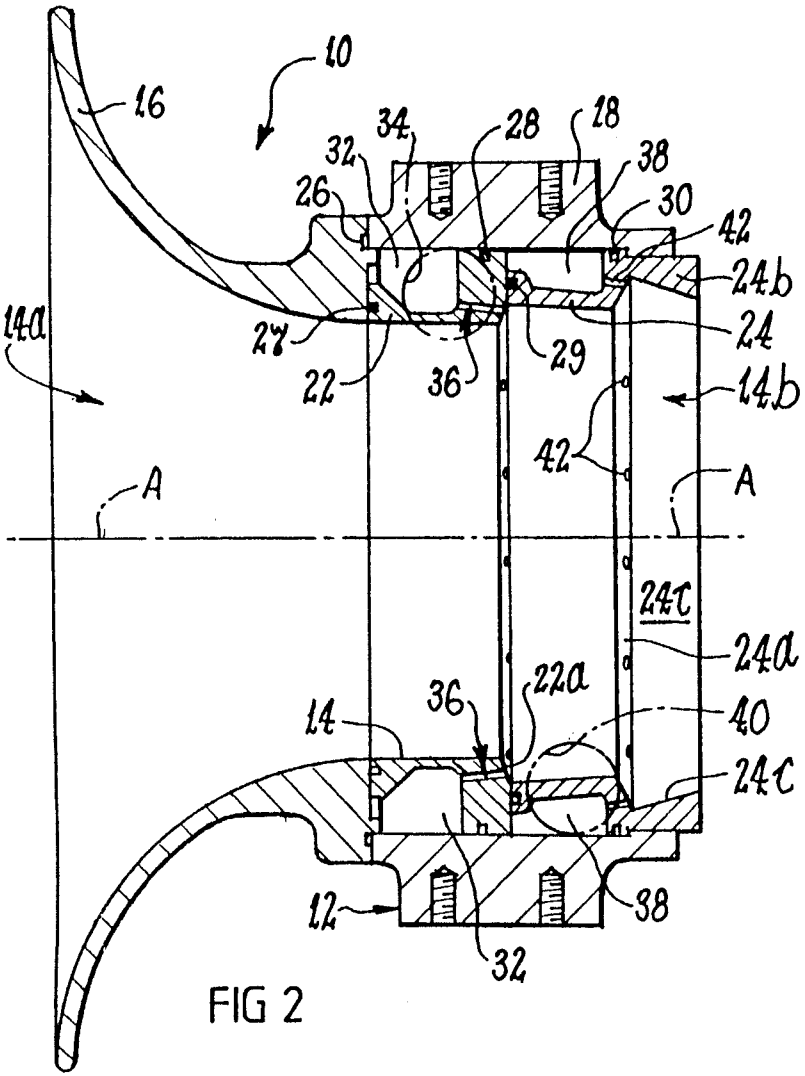
FIG. 2 is a sectional view taken on line II—II of FIG. 1.

Turning first to FIGS. 1 and 2, the device 10 has a housing means 12 defining a through bore 14 extending between an intake end 14*a* and an outlet end 14*b*. Housing means 12 has an intake part 16, which flares outwardly and away from outlet end 14*b* of bore 14, and a hub part 18, with bore 14 extending through parts 16,18. Within hub part 18, housing means 12 further includes axially adjacent annular ring members 22,24. O-ring seal 26 provides sealing between parts 16 and 18, with O-ring seals 27,28 respectively provide sealing between ring member 22 and each of parts 16 and 18. Further O-ring seals 29,30 respectively provide sealing between ring members 22,24 and between ring member 24 and part 18.

Ring member 22 has an inner circumferential surface at which bore 14 is a smooth continuation of the curvature of the inner surface of intake part 16. As detailed below, ambient air is able to be drawn along bore 14, from end 14*a* thereof, and this smooth continuation facilitates avoidance of undue turbulence in air flow through bore 14.

A first annular chamber 32 is defined around ring member 22, between the latter and parts 16,18 of housing means 12. An inlet 34 to chamber 32 is defined by part 18. Inlet 34 enables device 10 to be connected to a source of pressurised air, for supply of air to chamber 32. Inlet 34 is substantially tangential to chamber 32, to facilitate a circumferential flow of air from inlet 34, around chamber 32.

Ring member 24 has a slightly larger internal diameter than member 22. Thus a radial, circumferential shoulder 22*a*, facing towards outlet end 14*b* of bore 14, is defined within bore 14 by member 22. Also, chamber 32 is in communication with bore 14 by means of a circumferentially spaced plurality of passages 36 operable, on supply of high pressure air to chamber 32, to discharge air jets into bore 14. Passages 36 have their outlet ends at shoulder 22*a* and extend, from inlet ends at chamber 32 axially to outlet ends at shoulder 22*a*, towards end 14*b* of bore 14. While passages 36 extend in the general direction of axis A—A of bore 14, they preferably are inclined with respect to axis A—A.

The preferred inclination of passages 36 is two-fold. Their inner ends at shoulder 22*a* are radially inwardly of their inner ends at chamber 32. Passages 36 thus are inclined towards axis A—A such that the line of each converges towards axis A—A, preferably towards a location on axis A—A substantially beyond outlet end 14*b* of bore 14. In this aspect, the inclination preferably is from 5° to 20°, most preferably from 7° to 17°, with respect to axis A—A. However, each passage 36 also is inclined in a similar direction such that each is not located in a radial plane containing axis A—A. Rather each passage 36 is transverse with respect to such plane and axis A—A. In this aspect, the inclination of each passageway 36 preferably is from 2° to 10°, most preferably from 3° to 8° transversely with respect to axis A—A The similar inclination of passages 36 transversely of axis A—A is in a common circumferential direction, and such that the flow of air from chamber 32 to passages 36 is in part a continuation of air flow around chamber 32.

In FIGS. 1 and 2, passages 36 are of constant cross-section throughout their length, preferably of circular cross section. FIG. 2A shows an alternative form. In FIG. 2A passages 36 have a two-fold inclination as described with reference to FIGS. 1 and 2. However, at their end adjacent to chamber 32, the inlet to each passage 36 is rounded at 36*a* to facilitate the flow of air therethrough from chamber 32. Also, at their outlet end adjacent to shoulder 22*a*, each passage diverges frustoconically outwardly as shown at 36*b*, with a central region 36*c* thereof being of constant circular cross-section.

Figure 3:
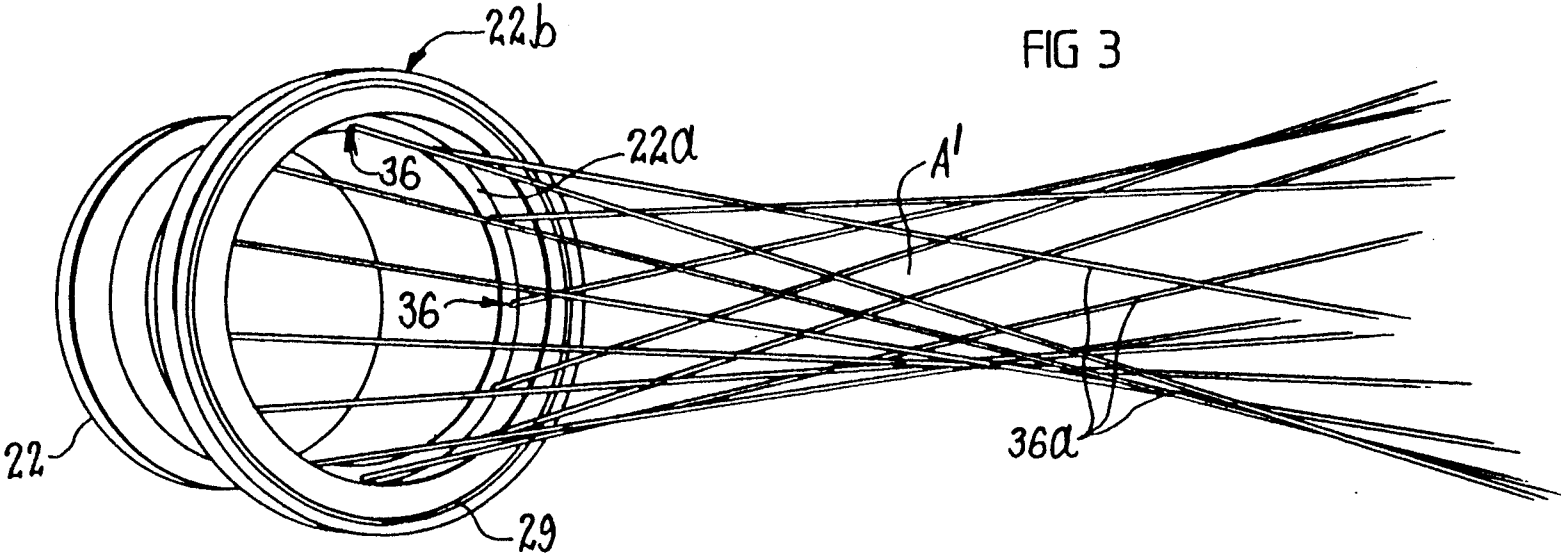
FIG. 3 is a perspective view of a modified form of a component of a device of FIG. 1, with a schematic representation of air flow generated by the component.

The result of the two-fold inclination of passages 36 is illustrated in FIG. 3, which shows a modified form of ring member 22 in perspective, as viewed from the outlet end of passages 36. The modified form does not differ significantly from that shown for member 22 of FIGS. 1 and 2. It simply shows an axial projection 22*b*, beyond shoulder 22*a*, enabling a greater axial spacing between chamber 32 and ring member 24. What is important in FIG. 3 is the manner in which high pressure air supplied to chamber 32 issues from chamber 32 to bore 14, via passages 36 as high pressure jets; the jets being depicted as idealised lines 36*a*. As shown, jet lines 36*a* converge towards axis A—A, as far as location A' on that axis downstream of ring member 22, and thereafter diverge from axis A—A. At location A', jet lines 36*a* define a minimum throat in the respective air flow. Also, jet lines 36*a* pass around axis A—A in a somewhat helical fashion. Jet lines 36*a* are shown as being as constant width, whereas each actual air jet from passages 36 of course will spread as it passes along bore 14. However, the arrangement minimises intersection of air jets and, hence, turbulance in the resultant air flow.

Returning to FIGS. 1 and 2 (and similarly for the alternative of FIGS. 2A), a second annular chamber 38 is shown as defined around ring member 24, between the latter, ring member 22 and hub part 18 of housing means 12. An inlet 40 to chamber 38 is defined by hub part 18. Inlet 40 enables device 10 to be connected to a source of pressurised water, for supply of water to chamber 38. Inlet 40 is substantially tangential to chamber 38 to facilitate a circumferential flow of water from inlet 40, around chamber 38.

Towards its end axially away from ring member 22, ring member 24 defines a radial, circumferential shoulder 24*a*, facing towards outlet end 14*b* of bore 14. Also, beyond shoulder 24*a*, ring member 24 has an axially extending annular flange 24*b* with a frusto-conical inner surface 24*c*. The arrangement is such that surface 24*c* decreases in radius axially beyond shoulder 24*a*.

Second chamber 38 is in communication with bore 14 by means of a circumferentially spaced plurality of water discharge ports 42 which have their outlet ends at shoulder 24*a*. Ports 42 are operable, on supply of high pressure water to chamber 38, to direct high pressure jets of water axially into bore 14, towards outlet end 14*b*.

Ports 42 are shown in FIG. 2 as being slightly inclined towards a location on axis A—A beyond end 14*b* of bore 14. Such inclination is preferred, but is not essential, as ports 42 can be parallel to, or even diverge slightly in the opposite direction away from axis A—A. However, the water jets from ports 42 tend to be relatively coherent streams, rather than broken down into droplets. Accordingly, they are caused to impinge on surface 24*c* of ring member 24 after short distance beyond shoulder 24*a*. The inclination of ports 42 relative to surface 24*c*, and the inclination of surface 24*c* to axis A—A, is such that the water jets flatten out against surface 24*c* and continue as relatively radially thin streams of water inclined towards axis A—A and the air flow in bore 14 produced by air jets issuing from passages 36. The inclination of the water streams is such that they converge with that air flow, beyond end 14*b* of bore 14, most preferably before the air stream reaches its minimum throat diameter at A'.

Figure 4:
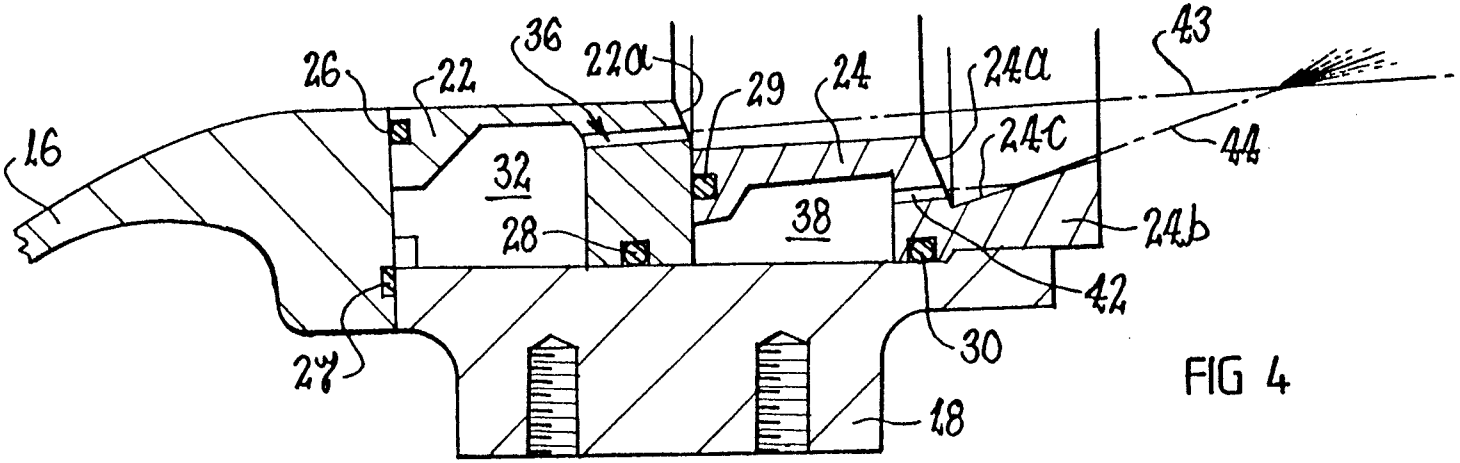
FIG. 4 is a partial sectional view of the device of FIG. 1, similar to the view of FIG. 2, but enlarged to provide a schematic representation of water and air flow.

Overall operation of device 10 is illustrated in FIG. 4, when considered in conjunction with FIG. 3. With device 10 having its inlets 34,40 respectively connected to a source of pressurised air and pressurised water, chambers 32,38 are respectively charged with air and water. Air jets 43, corresponding substantially to jet lines 36*a*, discharge into bore 14 and pass beyond end 14*b*. On issuing from passages 36, the air of jets 43 expand and is chilled, providing a reduced temperature flow of air issuing from end 14*b* of bore 14. Water jets 44 issue from ports 42 and impinge on surface 24*c* of ring member 24. Water jets 44 are flattened by surface 24*c* and are deflected by the latter so as to flow as radially thin streams of water which progressively break into droplets. The thinned streams 44 issue axially beyond end 14*b* of bore 14 in a circumferential array converging substantially at the frusto-conical angle of surface 24*b*. Streams 44 impinge on the air flow produced by air jets 43, and are broken up further into fine droplets which are chilled and form snow particles. Those snow particles are carried beyond device 10 and, by appropriate orientation of the latter, are able to be directed as a stream as required.

Air jets 43 generate a reduction in pressure in bore 14 upstream of ring member 22. As a consequence, ambient air is able to be drawn into bore 14 at end 14*a* thereof, and discharges from end 14*b* with the air flow generated by air jets 43. The aggregate air flow from end 14*b* thus is substantially increased and, subject to the temperature of the air supplied to chamber 32, the extent to which it is chilled on expansion as air jets 43, the temperature of water supplied to chamber 38, and the ambient air temperature, the volume of water issuing as jets 44 and hence the volume of snow produced can be increased. The pressurised air and water supplies for use of device 10 of FIGS. 1 and 2 preferably are at a temperature of not more than 3° C., most preferably not more than 1° C.; while the ambient air temperature preferably is not more than 7° C., most preferably less than 3° C. Overall cooling, under such conditions, is enhanced by the temperature drop of at least 10° C. in the pressurised air, on its expansion as air jets 43; a drop of 10° C. being obtained with an air pressure drop of 700 Kpa.

While the air and water pressures may both be not more than 3° C., this is not necessary. Thus, while air may be able to be supplied at such temperature, achieving water at such low temperature in a sufficient volume may present difficulties. It is found that, provided the temperature of the air supply is correspondingly lowered, water at a higher temperature can be used. Thus, with the air supply at a temperature down to about −15° C., the water temperature can range up to about 15° C., and still be suitable for efficient snow making.

When use is made of the alternative form for passages 36 shown in FIG. 2A, it is found that passages 36 function as Venturies. That is, passages 36 of that form create stronger air jets 43, providing a greater volume of air, within bore 14. As a consequence of the stronger air jets 43, an increased volume of air is drawn into end 14*a* of bore 14, and facilitates snow making. The overall increase in air volume further enables the constraint on air and water supply temperatures to be relaxed, enabling snow making under less favourable ambient conditions, such as in an indoor ice-rink installation, or the like.

Figure 5:
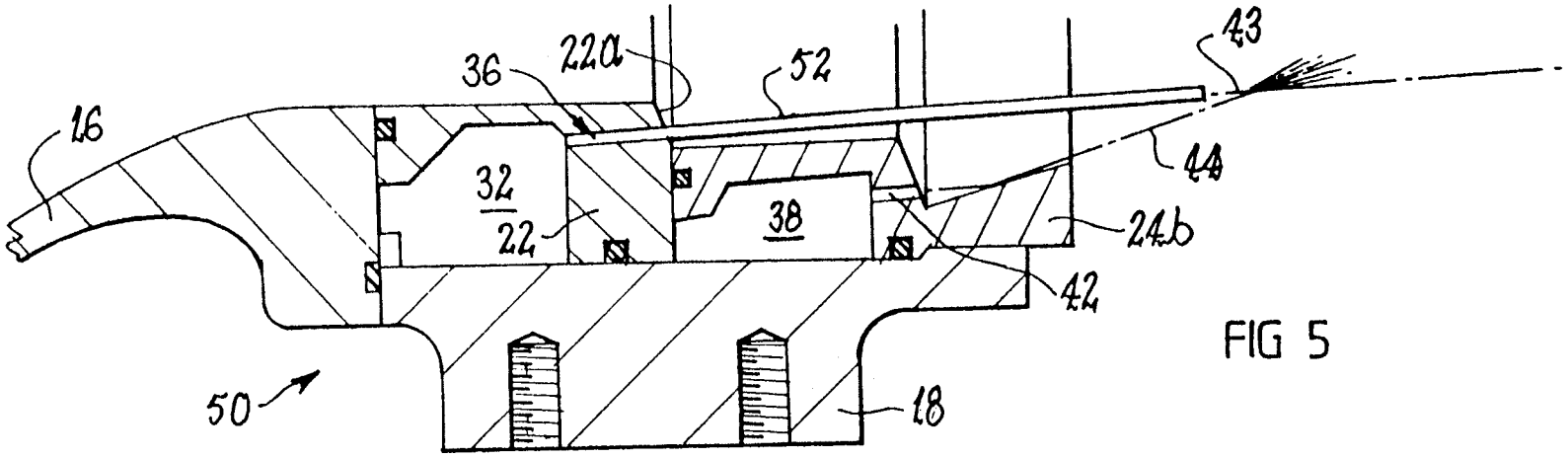
FIGS. 5 and 6 are views similar to FIG. 4, but illustrating respective alternative embodiments of the invention.
Figure 6:
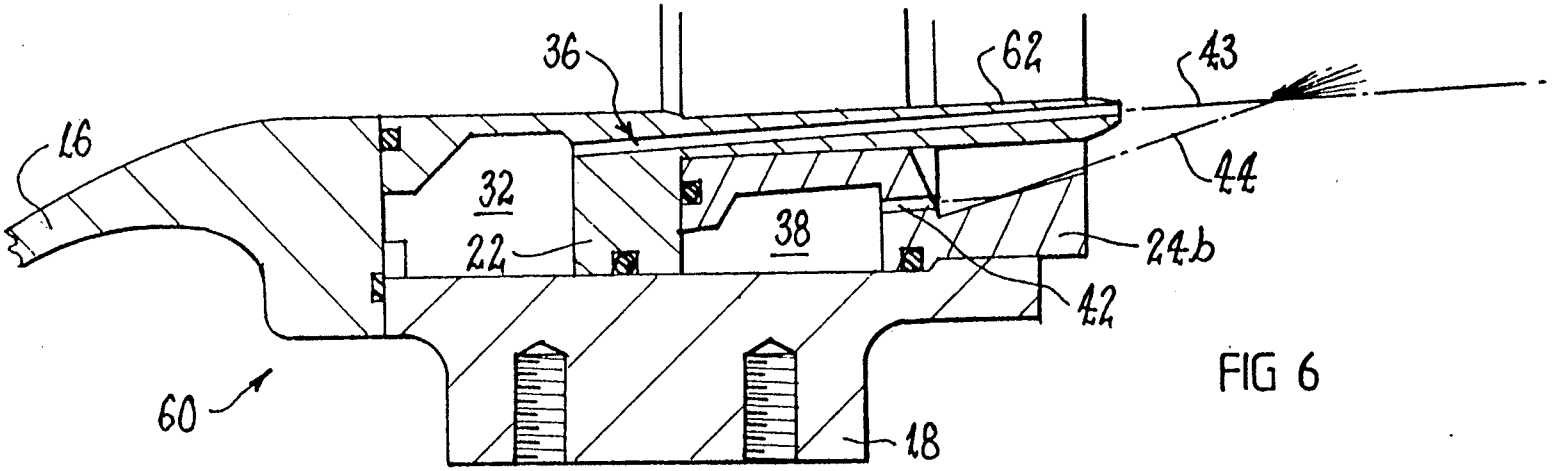

FIGS. 5 and 6 show respective alternative devices 50,60 in which parts corresponding to device 10 of FIGS. 1 and 2 have the same reference numerals. In device 50, each passageway 36 is extended in its two-fold inclination by a respective extension tube 52 which preferably is screw threaded onto ring member 22. The outlet end of each passage thus is beyond the end 14*b* of bore 14 and, as a consequence, little if any ambient air will be drawn through bore 14 from end 14*a*. The air flow thus is limited to that provided by air jets 43, such that the full chilling effect resulting from expansion of that air is available for snow making. The total amount of air flow through bore 14 is reduced and, as a result, there is a reduction in the volume of water able to be issued via water jets 44, and a reduction in the volume of snow able to be made. However, the snow can be enhanced quality, while snow is able to be made at higher ambient temperatures such as up to about 10° C.

Tubes 52 can be fitted, or removed, depending on ambient conditions. Where device 50 is to be able to be used without tubes 52 (i.e. as device 10), tubes 52 preferably correspond to the two-fold inclination of passages 36, as described above with reference to FIG. 3. However, where device 50 is to be used only with tubes 52 passages 36 may simply be inclined towards, and need not also be inclined transversely of, axis A—A.

Device 60 of FIG. 6 is similar to that of FIG. 5. However, in this case, extension of passages 36 is provided by a frusto-conical flange 62 of ring member 22 through which passages 36 extend to outlet ends just beyond end 14*b* of bore 14. Flange 62 preferably is integral with member 22, in which case device 60 can not revert to the form of device 10 of FIGS. 1 and 2. Operation of device 60 is essentially the same as for device 50 where the latter has tubes 52 fitted.

As with device 50 with tubes 52 fitted, device 60 does not result in ambient air being drawn along bore 14 from inlet end 14*a*. Passages 36 thus preferably are inclined towards, but not transversely of, axis A—A for ease of construction.

Figure 7:
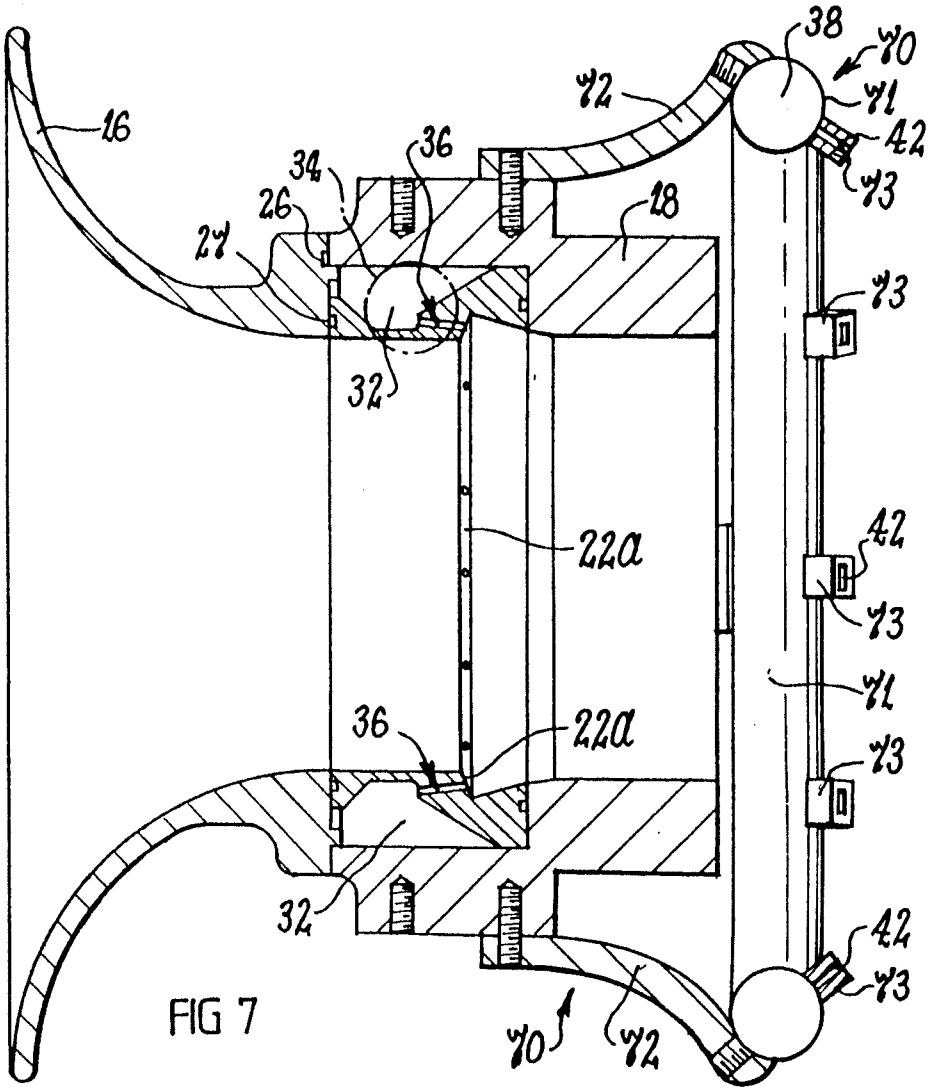
FIGS. 7 to 9 are sectional views of a device according to further respective embodiments of the invention.

FIG. 7 shows a further modified device 70 in which parts corresponding to those of FIGS. 1 and 2 have the same reference numeral. The essential difference is that ring member 24 of device 10 is omitted, and replaced by an annular manifold 71 mounted just beyond outlet end 14*b* of bore 14 and defining second chamber 38. Manifold 71 is secured on hub member 18 by brackets 72, and has an inlet (not shown) similar to inlet 40. Ports 42 of chamber 38 are defined by fittings 73 spaced around manifold 71 and oriented relative to axis A—A to direct the required water jets. Fittings 73 define ports 42 which are radially thin, circumferentially extending form, such that the water jets are of the required radially thin form able to break-up into droplets, without the need to impinge on a surface corresponding to surface 24*c* of FIGS. 1 and 2. Also, fittings 73 are directed such that the water jets issue at the required angle of from 2° to 10° to impinge on the air stream generated by air jets issuing from passages 36. However, overall operation with device 70 is essentially as described with reference to FIGS. 1 and 2.

Figure 8:
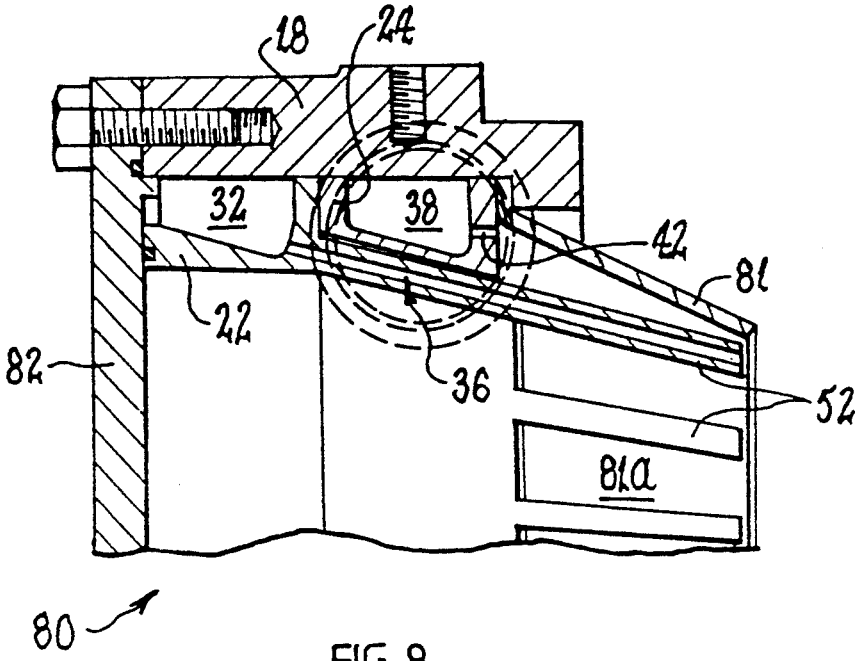
Figure 9:
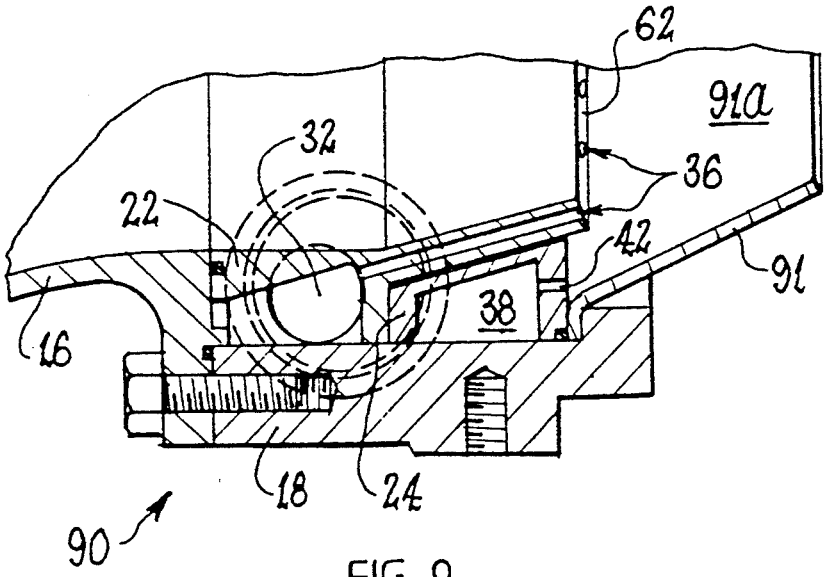

Devices 80 and 90 of FIGS. 8 and 9 correspond substantially to those of FIGS. 5 and 6, respectively. However, in each case, air passages 36 terminate within bore 14; with outlet end 14*b* of bore 14 being defined by a separate annular baffle 81,91, rather than by a continuation of ring member 24.

In device 80, passages 36 are in part defined by extension tubes 52. The latter terminate just short of, rather than beyond, end 14*b* of bore 14. Despite this, the resultant air jets from passages 36 will result in little reduction in pressure upstream of ring member 22, and there thus will be little tendency for ambient air to be drawn in. However, an end plate or baffle 82 of housing means 12 is fitted across the inlet end 14*a* of bore 14, in place of intake part 16, such that induction of ambient air is precluded.

Ports 42 from second chamber 38 extend parallel to axis A—A. However, water jets issuing from ports 42 impinge on frusto-conical surface 81*a* of baffle 81, with that surface functioning in the same way as surface 24*c* of device 10 of FIGS. 1 and 2. Operation of device 80 will be readily understood from the foregoing description.

In device 90, passages 36 are partly defined by frusto-conical flange 62 of ring member 22. The latter terminates a sufficient distance upstream of the outlet end 14*b* of bore 14 for ambient air to be able to be drawn through bore 14 via inlet end 14*a*. Device 90 thus retains air intake part 16 of housing means 12, to permit ambient air to be inducted. Again, ports 42 are substantially parallel to axis A—A, and the water jets thus are deflected by surface 91*a* of baffle 91. Beyond this, operation with device 90 will be apparent from the foregoing description.

In devices 50, 60, 70, 80 and 90, of respective FIGS. 5 to 9, passages 36 may be as described with reference to FIGS. 1 and 2. That is, they may be of constant cross-section throughout their length. However, they may alternatively be of the form shown in FIG. 2A, so as to provide a Venturi action.

Finally, it is to be understood that various alterations, modifications and/or additions may be introduced into the constructions and arrangements of parts previously described without departing from the spirit or ambit of the invention.

I claim:

1. Snow making apparatus, including a housing means which defines a bore having first and second ends, the bore being open at said second end to define an outlet; the housing means further defining first and second chambers which extend around the axis of the bore, and first and second connecting means for connecting the first and second chamber respectively to a source of pressurized water and a source of pressurized air; the housing means further defining a circumferential array of outlet means from the first chamber which are operable such that, with pressurized water supplied to the first chamber, a respective one of a plurality of jets of water is directed from each outlet means along and towards the axis of the bore; the housing means further defining a circumferential array of passages by which the second chamber is in communication with the bore, each passage having an inlet end communicating with the second chamber and an outlet end opening towards the second end of the bore; the arrangement of the passages being such that pressurized air supplied to the second chamber via the second connecting means is able to be discharged via the passages as a plurality of air jets which are directed towards and beyond the second end of the bore, to generate a flow of air which passes beyond the second end of the bore such that, in use of the apparatus, the jets of water impinge on the flow of air generated by said air jets to thereby generate snow particles which are carried axially beyond the second end of the bore; wherein the passages are inclined towards the bore axis and wherein the passages have their outlet ends spaced axially from the second end of the bore, with the angle of inclination of the passages towards the bore axis such that lines of continuation of the passages converge towards a location on the bore axis beyond said second end.

2. Apparatus according to claim 1, wherein the inclination towards the bore axis is at an angle of from 5° to 20°.

3. Apparatus according to claim 1, wherein the inclination towards the bore axis is at an angle of from 7° to 17°.

4. Apparatus according to claim 1, wherein the passages are also inclined transversely of the bore axis.

5. Apparatus according to claim 4, wherein the inclination transversely of the bore axis is from 2° to 10°.

6. Apparatus according to claim 4, wherein the inclination transversely of the bore axis is from 3° to 8°.

7. Apparatus according to claim 1, wherein said first chamber is defined by the housing means intermediate the second chamber and the second end of the bore.

8. Apparatus according to claim 7, wherein the housing means defines a frusto-conical surface which is intermediate the first chamber and the second end of the bore and which is positioned so as to deflect the water jets as radially thin streams directed to impinge on the air flow generated by the air jets.

9. Apparatus according to claim 1, wherein said first chamber is defined by an annular manifold of the housing means, said manifold being located around the second end of the bore and having said outlet means spaced therearound, each said outlet means being operable to direct a respective water jet as a radially thin stream.

10. Apparatus according to claim 1, wherein said bore is open at each of said first and second ends thereof, such that ambient air is able to be inducted into said bore at said first end for discharge from said second end with the air flow generated by said air jets.

11. Apparatus according to claim 10, wherein said housing means has a flared intake portion which defines the first end of said bore remote from said second end, a portion of the bore extending through said intake portion decreasing in radius towards said second end.

12. Apparatus according to claim 11, wherein said flared intake portion decreases in radius with a radius of curvature which exceeds the radius of the bore at the second chamber by a factor of up to 1.6.

13. Apparatus according to claim 1, wherein said bore is closed at the first end thereof, such that the flow of air which passes beyond said second end is generated solely by said air jets.

14. Apparatus according to claim 1, wherein each of said passages is of substantially constant cross-section throughout its length.

15. Apparatus according to claim 1, wherein each of said passages is rounded at its inlet end to facilitate the flow of air therethrough from the second chamber, and tapers frusto-conically outwardly at its outlet end so as to function as a Venturi.

16. A method of making snow, using apparatus according to claim 1, wherein pressurized sources of water and air are connected respectively to the first and second connecting means, to supply water and air respectively to said first and second chambers, and wherein water jets are caused to issue from said outlet means and to impinge on a flow of air, discharged from the second end of the bore by air jets issuing from said passages, to thereby generate snow particles.

17. Snow making apparatus, including a housing means which defines a bore having first and second ends, the bore being open at said second end to define an outlet; the housing means further defining first and second chambers which extend around the axis of the bore, and first and second connecting means for connecting the first and second chamber respectively to a source of pressurized water and a source of pressurized air; the housing means further defining a circumferential array of outlet means from the first chamber which are operable such that, with pressurized water supplied to the first chamber, a respective one of a plurality of jets of water is directed from each outlet means along and towards the axis of the bore; the housing means further defining a circumferential array of passages by which the second chamber is in communication with the bore, each passage having an inlet end communicating with the second chamber and an outlet end opening towards the second end of the bore; the arrangement of the passages being such that pressurized air supplied to the second chamber via the second connecting means is able to be discharged via the passages as a plurality of air jets which are directed towards and beyond the second end of the bore, to generate a flow of air which passes beyond the second end of the bore such that, in use of the apparatus, the jets of water impinge on the flow of air jets generated by said air jets to thereby generate snow particles which are carried axially beyond the one end of the bore, wherein said first chamber is defined by the housing means intermediate the second chamber and the second end of the bore, and the first and second chambers are separated such that the jets of water are substantially free of air and the air jets are substantially free of water.

18. Apparatus according to claim 17, wherein the passages are inclined towards the bore axis at an inclination angle of from 5° to 20°, and wherein the passages are also inclined transversely of the bore axis at a transverse inclination angle of from 2° to 10°.

19. Apparatus according to claim 17, wherein the passages have their outlet ends spaced axially from the second end of the bore, with an angle of inclination of the passages towards the bore axis such that lines of continuation of the passages converge towards a location on the bore axis beyond said second end.

20. Apparatus according to claim 17, wherein the housing means defines a frusto-conical surface which is intermediate the first chamber and the second end of the bore and which is positioned so as to deflect the water jets as radially thin streams directed to impinge on the air flow generated by the air jets.

21. Apparatus according to claim 17, wherein said first chamber is defined by an annular manifold of the housing means, said manifold being located around the second end of the bore and having said outlet means spaced therearound, each said outlet means being operable to direct a respective water jet as a radially thin stream.

22. Apparatus according to claim 17, wherein said bore is open at each of said first and second ends thereof, such that ambient air is able to be inducted into said bore at said first end for discharge from said second end with the air flow generated by said air jets.

23. Apparatus according to claim 22, wherein said housing means has a flared intake portion which defines the first end, a portion of the bore extending through said intake portion decreasing in radius towards said second end, and wherein said flared intake portion decreases in radius with a radius of curvature which exceeds the radius of the bore at the second chamber by a factor of up to 1.6.

24. Apparatus according to claim 17, wherein said bore is closed at the first end thereof, such that the flow of air which passes beyond said second end is generated solely by said air jets.

25. Apparatus according to claim 17, wherein each of said passage is rounded at its inlet end to facilitate the flow of air therethrough from the second chamber, and tapers frusto-conically outwardly at its outlet end so as to function as a Venturi.

26. Snow making apparatus, including a housing means which defines a bore having first and second ends, the bore being open at said second end to define an outlet; the housing means further defining first and second chambers which extend around the axis of the bore, and first and second connecting means for connecting the first and second chamber respectively to a source of pressurized water and a source of pressurized air; the housing means further defining a circumferential array of outlet means from the first chamber which are operable such that, with pressurized water supplied to the first chamber, a respective one of a plurality of jets of water is directed from each outlet means along and towards the axis of the bore; the housing means further defining a circumferential array of passages by which the second chamber is in communication with the bore, each passage having an inlet end communicating with the second chamber and an outlet end opening towards the second end of the bore; the arrangement of the passages being such that pressurized air supplied to the second chamber via the second connecting means is able to be discharged via the passages a plurality of air jets which are directed towards and beyond the second end of the bore, to generate a flow of air which passes beyond the second end of the bore such that, in use of the apparatus, the jets of water impinge on the flow of air generated by said air jets to thereby generate snow particles which are carried axially beyond the second end of the bore; wherein said bore is closed at the first end thereof such that the flow of air which passes beyond said second end is generated solely by said air jets.

27. Apparatus according to claim 26, wherein the passages are inclined towards the bore axis at an inclination angle of from 5° to 20°, and wherein the passages are also inclined transversely of the bore axis at a transverse inclination angle of from 2° to 10°.

28. Apparatus according to claim 26, wherein the passages have their outlet ends spaced axially from the second end of the bore, with the angle of inclination of the passages towards the bore axis such that lines of continuation of the passages converge towards a location on the bore axis beyond said second end.

29. Apparatus according to claim 26, wherein said first chamber is defined by the housing means intermediate the second chamber and the second end of the bore.

30. Apparatus according to claim 29, wherein the housing means defines a frusto-conical surface which is intermediate the first chamber and the second end of the bore and which is positioned so as to deflect the water jets as radially thin streams directed to impinge on the air flow generated by the air jets.

31. Apparatus according to claim 26, wherein said first chamber is defined by an annular manifold of the housing means, said manifold being located around the second end of the bore and having said outlet means spaced therearound, each said outlet means being operable to direct a respective water jet as a radially thin stream.

32. Apparatus according to claim 26, wherein each of said passages is rounded at its inlet end to facilitate the flow of air therethrough from the second chamber, and tapers frusto-conically outwardly at its outlet end so as to function as a Venturi.

* * * * *